US008083502B2

(12) United States Patent
Ballu

(10) Patent No.: US 8,083,502 B2
(45) Date of Patent: Dec. 27, 2011

(54) SUBMERSIBLE PUMP

(75) Inventor: Patrick Ballu, Reims (FR)

(73) Assignee: Exel Industries, Reims (FR)

( * ) Notice: Subject to any disclaimer, the term of this patent is extended or adjusted under 35 U.S.C. 154(b) by 577 days.

(21) Appl. No.: 12/285,953

(22) Filed: Oct. 16, 2008

(65) Prior Publication Data

US 2009/0116984 A1 May 7, 2009

(30) Foreign Application Priority Data

Oct. 18, 2007 (FR) ..... 07 58410

(51) Int. Cl.
*F04B 35/04* (2006.01)

(52) U.S. Cl. ..... 417/423.3; 417/423.9

(58) Field of Classification Search ..... 417/423.3, 417/313, 423.9, 423.14; 248/346.01, 346.03, 248/346.04, 346.5

See application file for complete search history.

(56) References Cited

U.S. PATENT DOCUMENTS

| | | | | |
|---|---|---|---|---|
| 3,746,472 | A * | 7/1973 | Rupp | 417/9 |
| 5,181,841 | A * | 1/1993 | Kirkland | 417/423.3 |
| 5,399,075 | A * | 3/1995 | Frank et al. | 417/423.1 |
| 5,833,437 | A * | 11/1998 | Kurth et al. | 417/36 |
| 6,390,780 | B1 * | 5/2002 | Batchelder et al. | 417/36 |
| 6,715,994 | B2 * | 4/2004 | Patel et al. | 417/12 |
| 2004/0191062 | A1 * | 9/2004 | Dahlheimer | 415/231 |
| 2005/0214143 | A1 * | 9/2005 | Stirling et al. | 417/423.9 |
| 2007/0048157 | A1 * | 3/2007 | Collins et al. | 417/423.3 |

FOREIGN PATENT DOCUMENTS

| | | | |
|---|---|---|---|
| DE | 23 25 285 | A1 | 11/1974 |
| DE | 200 10 492 | U1 | 12/2000 |
| DE | 10 2005 031420 | | 1/2007 |
| EP | 1 186 782 | A | 3/2002 |
| GB | 1 486 277 | A | 9/1977 |

OTHER PUBLICATIONS

Versa-Matic Pump Brochure for SludgeMaster Submersible Pump, Warren Rupp, Inc., Jul. 28, 2004.*

* cited by examiner

*Primary Examiner* — Devon C Kramer
*Assistant Examiner* — Christopher Maxey
(74) *Attorney, Agent, or Firm* — Dowell & Dowell, PC

(57) ABSTRACT

A submersible pump for removing liquids from an enclosure having at least one outlet socket for discharging liquid from the enclosure, an electric actuator with a rotary output shaft, a bladed wheel within the enclosure and driven by the actuator and rotating about an axis of the output shaft and wherein a wall of the enclosure is defined by a base having at least one inlet orifice for drawing liquids into the enclosure, and a plate mounted in a reversible manner within the enclosure and close to the base in two distinct configurations, and wherein in one mounting configuration a first cavity of a first dimension is created adjacent the base for the passage of a liquid laden with solid particles and in the other mounting configuration a second cavity of a second dimension is created adjacent the base for the passage of a clear liquid.

11 Claims, 4 Drawing Sheets

SUBMERSIBLE PUMP

BACKGROUND OF THE INVENTION

1. Field of the Invention

The present invention relates to a submersible pump having a reversible plate having intake openings that allow the pump to be used for pumping both liquids laden with solid particles and clear liquids that are generally free of solid particles depending on the orientation of the plate relative to a base of the pump.

2. Description of the Related Art

A submersible pump for clearing away a liquid laden with solid particles is usually designed for clearing away particles from the volume to be treated. The solid particles to be cleared away may have a generally spherical shape whose diameter may reach 30 mm. To clear them away, the pump is submerged in the volume to be treated. The submerged pump clears away the liquid with the particles that it contains. Such a pump therefore makes it possible also to clear away a clear liquid.

However, after the particles and the liquid have been cleared away by a pump for laden liquid, the depth of residual liquid in the volume to be dried out is relatively large, because the level of the inlet orifice of the pump relative to the floor must be greater than the maximum size of the particles to be cleared away.

Conversely, a submersible pump for clearing away a clear liquid has an inlet orifice submerged closer to the floor than that of a pump for laden liquid, which makes it possible to reduce the depth of residual liquid in the volume to be dried out. However, a pump for clear liquid does not make it possible to clear away solid particles of significant size.

Depending on its structural features, a submersible pump of the prior art is intended either for clearing away, or evacuating, a liquid laden with solid particles, or for the virtually complete clearing, or evacuating, of a clear liquid, but not for both of these uses. The user must therefor choose, at a time of purchase, between these two types of submersible pumps, depending on the desired use.

The chosen pump allows him to achieve only one of the two uses. To achieve both, the user must buy the two different submersible pumps, which increases the expenditure and space requirement necessary for these two pumps.

SUMMARY OF THE INVENTION

The object of the present invention is in particular to remedy these disadvantages, by proposing a submersible and reversible pump for clearing away laden liquids or clear liquids.

Accordingly, the invention relates to a submersible pump, for removing liquids, comprising:

- an enclosure having at least one socket for the outlet of liquid communicating with the outside of the enclosure,
- an electric actuator with a rotary output shaft,
- a bladed wheel placed in the enclosure, driven by the actuator and capable of rotating about the axis of the output shaft.

According to the invention, a wall of the enclosure is defined by a base having at least one inlet orifice communicating with the outside of the enclosure, and the pump comprises a plate capable of being mounted in a reversible manner close to the base in two distinct configurations, a first mounting configuration being designed for the passage of a liquid laden with solid particles, the other mounting configuration being designed for the passage of a clear liquid, the enclosure having a volume that is cleared between the inlet orifice and the outlet socket, so as to allow the liquid laden with solid particles to flow away.

In addition, the plate has at least one first opening and the plate is capable of forming with the base at least one first cavity, the dimensions of the or each first opening and of the or each first cavity being suitable for the passage of the liquid laden with solid particles. The plate has at least one second opening and the plate is capable of forming with the base at least one second cavity, the dimensions of the or each second opening and of the or each second cavity being suitable for the passage of the clear liquid.

The pump that is the subject of the invention therefore makes it possible on the one hand to remove a liquid laden with particles of significant size and, on the other hand, to minimize the depth of residual liquid in a volume to be dried out. The conversion of the pump between its two configurations is carried out by simple operations.

According to advantageous but optional features, taken in isolation or in any technically possible combination:

- the plate has a portion common to the first cavity and to the second cavity, said common portion being drilled with at least one hole for the passage of laden or clear liquid;
- abutment means are provided on the base and/or on the plate in order to position the plate relative to the base, so as to form the first cavity or the second cavity;
- said wall defines the bottom of the enclosure and the outlet socket is on the upper portion of the enclosure, when the pump is in the position of use;
- the axis of the output shaft is vertical when the pump is in the position of use, and the bladed wheel comprises centrifugal-action blades;
- the inlet orifice is level with the axis of the output shaft and the plate has several holes distributed for the passage of liquid, the holes being placed in a symmetrical manner relative to the axis of the output shaft;
- the respective discharging cross sections of the first cavity, of the inlet orifice and of the volume each have a minimal dimension of more than 30 mm;
- the dimensions of the or each first opening are smaller than the dimensions of the respective discharging cross sections of the first cavity, of the inlet orifice and of the volume, in order to prevent the solid particles that must be removed from being jammed in the pump;
- the plate comprises at least one item of information on its mounting configuration, preferably on one and/or on the other of its faces, depending on the nature of the liquid to be removed;
- the plate is fastened to the base by means of fastening elements that can be accessed from the outside of the enclosure;
- at least one face of the plate has a flat bearing surface designed to support the pump in a stable manner on a flat floor.

DESCRIPTION OF THE DRAWINGS

The invention will be well understood and other advantages of the latter will also appear in the light of the following description of an embodiment of the invention made with reference to the attached drawings in which.

DESCRIPTION OF THE PREFERRED EMBODIMENTS

Figure 1:
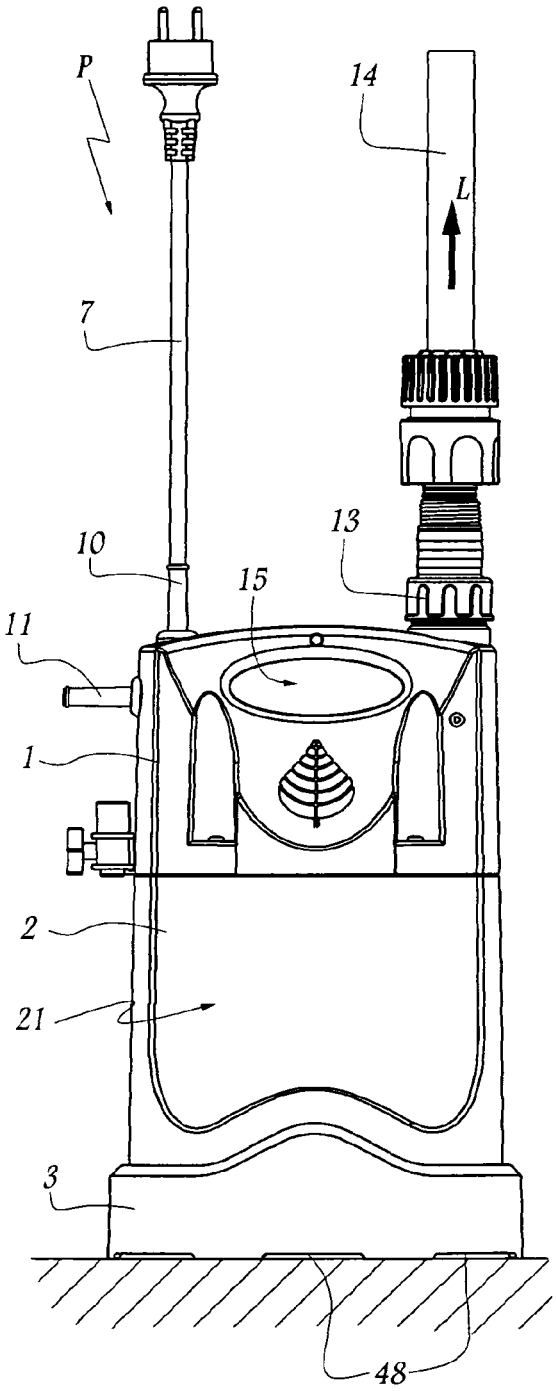
FIG. 1 is a front view of a pump according to the invention configured for removing a clear liquid.
Figure 2:
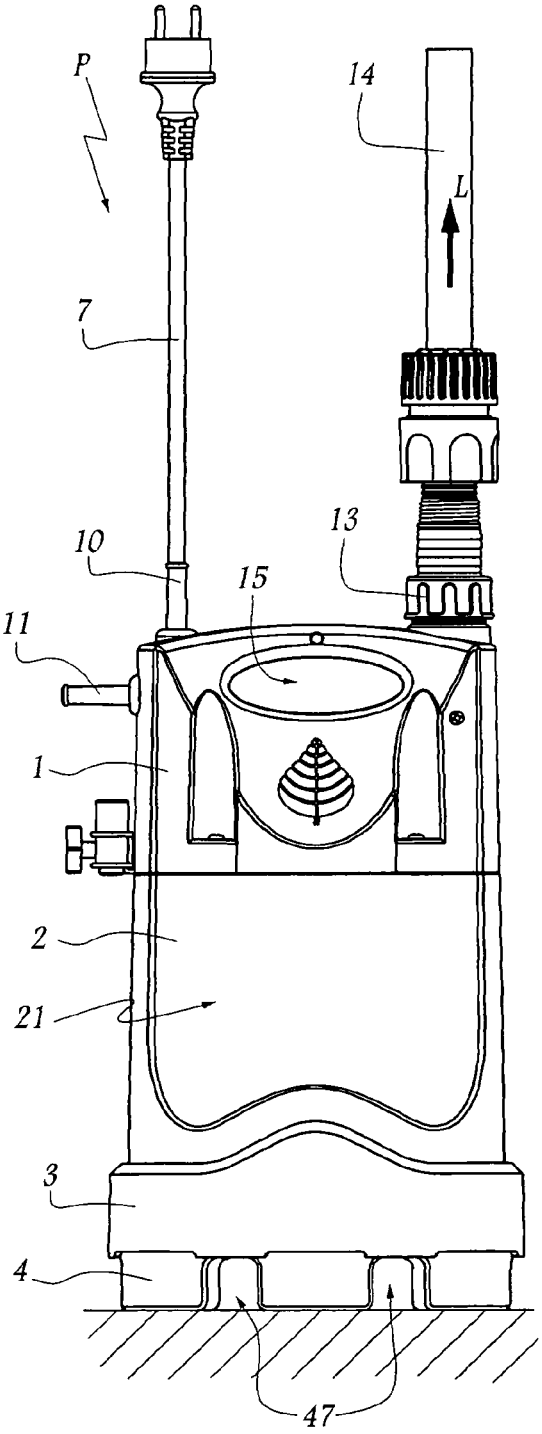
FIG. 2 is a front view of the pump of FIG. 1 configured for removing a laden liquid.

FIG. 1 illustrates a submersible pump P formed by a top half-casing 1 and a bottom half-casing 2. The half-casing 1 is used for protecting the electric components and for picking up the pump P by means of a handle 15. The half-casing 2 comprises an enclosure 21 designed to contain the liquid to be removed or to be cleared away. The top half-casing 1 and bottom half-casing 2 are formed by solid walls, so as to render the enclosure 21 sealed from the liquids to be cleared away. The enclosure 21 may be partially or totally submerged in a liquid. The terms top, bottom, upper and lower relate to the position of service of the pump, as illustrated by FIGS. 1 and 2.

The pump P comprises a base 3 and a plate 4 at which the liquid to be cleared away is aspirated. In the configuration illustrated by FIG. 1, for removing away a clear liquid, the pump P rests on the base 3 and on the plate 4. In this configuration, the plate 4 is housed in the free volume inside the base 3, so that the plate is not visible in FIG. 1 in front view, but is visible in FIG. 3. In the configuration illustrated by FIG. 2, for removing of a liquid laden with solid particles, the pump P rests only on the plate 4 which forms a protrusion beneath the base 3.

The top half-casing 1 is fitted with an outlet socket 13 through which the liquid L can be cleared away. A pipe 14 may be connected to this socket 13 in order to carry the liquid L at a distance from the site to be treated. In the example of FIGS. 1 and 2, the socket 13 is placed on the upper face of the half-casing 1. According to a variant not shown, the socket 13 may be fitted to a side face of the pump P.

Furthermore, the enclosure 21 is fitted with glands stuffing boxes 10 and 11 designed to receive respectively a cable 7 for providing the pump P with electric power and a cable not shown for controlling the pump P.

Figure 3:
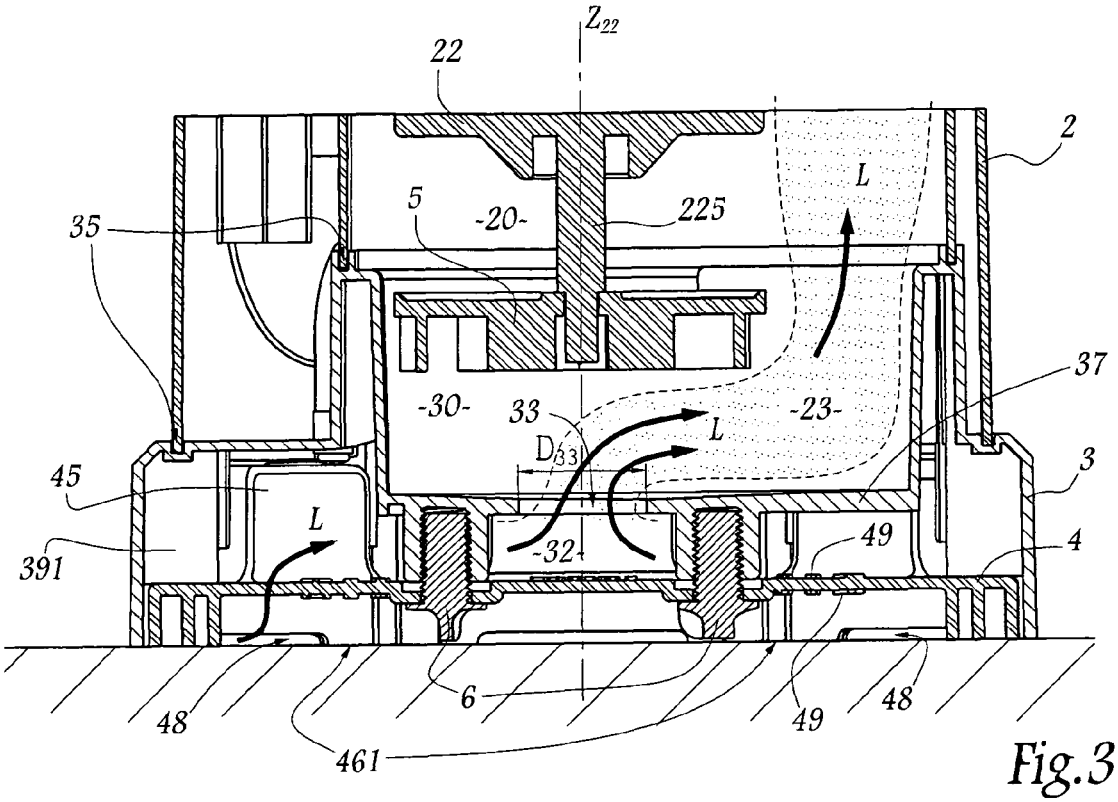
FIG. 3 is a section on a larger scale of the bottom portion of the pump of FIG. 1.

As shown in FIG. 3, the base 3 is placed next to the bottom of the bottom half-casing 2. The enclosure 21 defines a main volume 20, in which an electric motor 22 supplied by the cable 7 is housed. The motor 22 comprises an output shaft 225 that rotates and extends along an axis $Z_{22}$. The axis $Z_{22}$ is vertical in FIG. 2 and when the pump P rests on a horizontal floor.

A bladed wheel 5 is secured to the output shaft 225 by means of a nut not shown. The bladed wheel 5 rotates about the axis $Z_{22}$ when the output shaft 225 is rotated by the motor 22. The bladed wheel 5 is in this instance of the centrifugal type and it makes it possible to move the liquid to be cleared away along flow lines symbolized by the arrows L in FIGS. 3 and 4.

Irrespective of the nature of the liquid L, laden or clear, it flows from the bottom of the pump P, where it is aspirated at the plate 4 and the base 3, to the top of the pump P, where it is cleared away through the socket 13. The socket 13 therefore places the enclosure 21 in communication with the outside of the enclosure 21.

Figure 4:
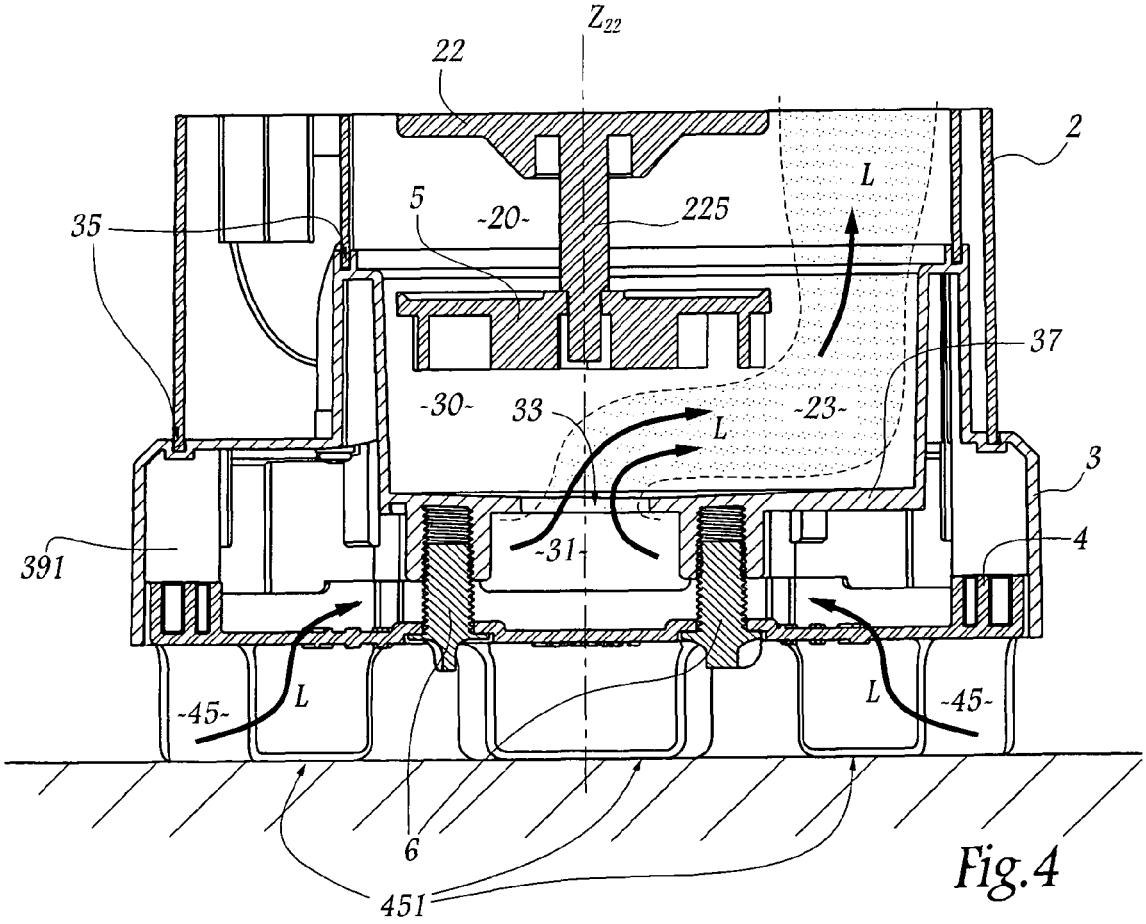
FIG. 4 is a section similar to FIG. 3 of the bottom portion of the pump of FIG. 2.

As shown by the comparison between FIGS. 3 and 4, the plate 4 is capable of being mounted in a reversible manner on the base 3. The mounting configuration illustrated by FIG. 4 is designed for the passage of a liquid laden with solid particles, whereas the other mounting configuration, illustrated by FIG. 3, is designed for the passage of a clear liquid. The main difference between the configurations of the pump P for clearing away a laden liquid or a clear liquid lies in the dimensions of the respective discharging cross sections delimited by the geometry of each face of the plate 4.

As shown by FIGS. 5 to 8, the plate 4 comprises a central, generally elliptical tray 40 having a first face 41 and a second face 42 that are generally flat and parallel with one another. The tray 40 is pierced with four holes 43, two of which are visible in section in FIG. 8, designed for the passage of a clear liquid or of a laden liquid. This is why each of the holes 43 has a circular shape of diameter $D_{43}$ that is greater than the maximum size of the particles to be removed.

Six feet 45 extend from the second face 42 around the tray 40 and perpendicularly to the latter. The soles 451 of the six feet 45, which extend substantially parallel to the tray 40, are coplanar and they allow the pump P to rest in a stable manner on a flat floor in the configuration of FIGS. 2 and 4.

Drill holes 452 are made in the soles 451 in order to connect the inner recess of each foot 45 to the outside of the pump P, which allows the flow of the liquid outside the feet 45 and therefore prevents this liquid from stagnating.

The six feet 45 define between them, in twos, six similar notches 47 each having a width $L_{47}$ and a height $H_{47}$. Each notch 47 defines a first opening limiting the size of the particles capable of being aspirated during the pumping of a laden liquid in the configuration of FIGS. 2 and 4. Therefore, when the plate 4 is mounted on the base 3 with the second face 42 turned toward the floor, as shown in FIGS. 2 and 4, the pump P is configured for clearing away a laden liquid.

Similarly, in the configuration of FIGS. 1 and 3, the plate 4 comprises abutments 46 which extend above the first face 41 and which are separated in twos by cuts or cracks 48. The outer surfaces of the abutments 46 define coplanar soles 461, such that they allow the pump P to rest in a stable manner on a flat floor. In addition, in this configuration, the plate 4 coincides perfectly with the plane defined by the soles 361 of abutments 36 belonging to the base 3.

Each cut 48 has an elongated curvilinear shape and a height $H_{48}$ that is small compared with the height $H_{47}$. The height $H_{48}$ strongly limits the size of the solid particles capable of being aspirated during pumping in the configuration of FIGS. 1 and 3. In this configuration, the cuts 48 of the plate 4 coincide with cut 38 of the base 3, which prevents generating a restriction of the flow at the passage of liquid, while maximizing the bearing surface area of the pump P on the floor. Therefore, when the plate 4 is mounted on the base 3 with the first face 41 turned towards the floor, as shown in FIGS. 1 and 3, the pump P is configured for removing a clear liquid or, at least, a liquid laden with particles having a size less than the height $H_{48}$.

Since the feet 45 and the abutments 46 protrude on either side of the tray 40, the latter is capable of forming with the base 3 a first cavity 31, that can be seen in FIG. 4, and a second cavity 32, that can be seen in FIG. 3. The tray 40 is common with the first cavity 31 and second cavity 32. Along the axis $Z_{22}$, the first cavity 31 is higher than the second cavity 32, and higher than the maximum size of the particles to be cleared away.

Figure 9:
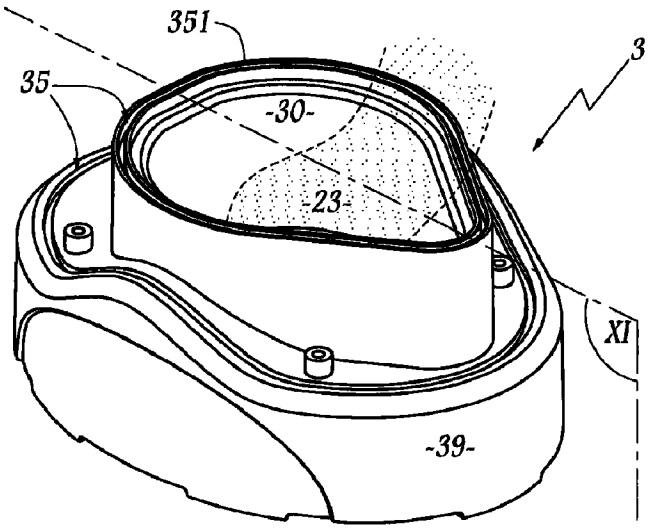
FIG. 9 is a view in perspective of the base of the pump of FIGS. 1 to 4, on a larger scale and at the angle of FIG. 5.
Figure 11:
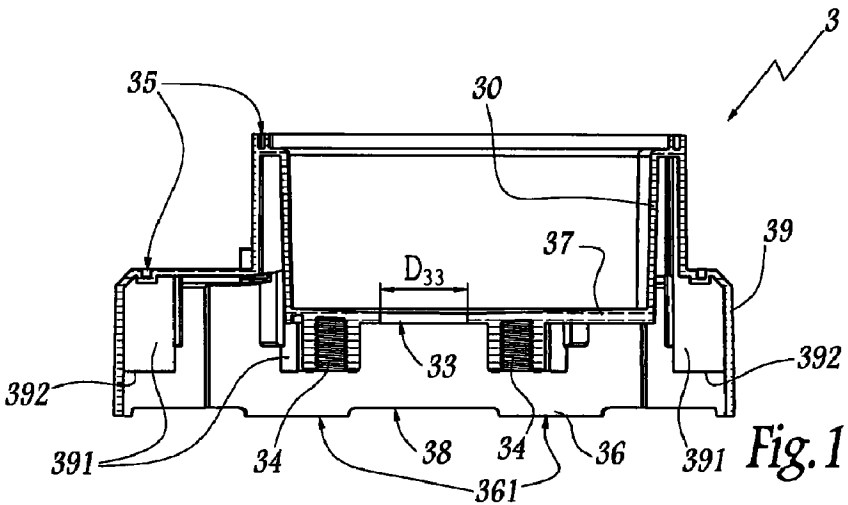
FIG. 11 is a section of the base of FIGS. 9 and 10 along the plane XI in FIG. 9.
Figure 8:
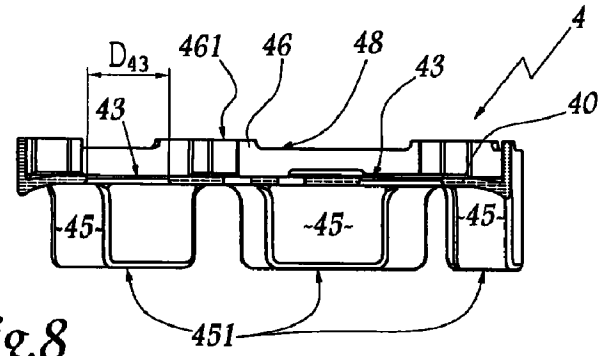
FIG. 8 is a section, on a smaller scale and along the plane VIII of FIG. 5, of the plate of FIG. 5.
Figure 10:
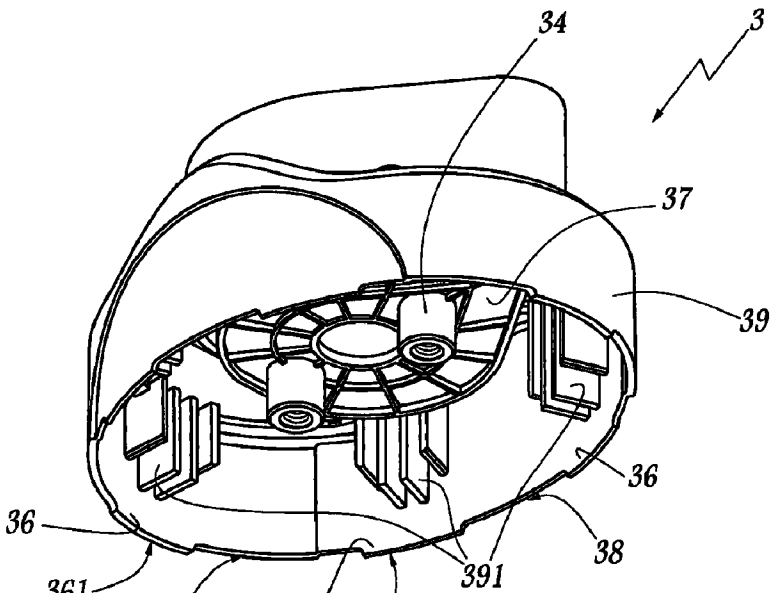
FIG. 10 is a view in perspective of the base of FIG. 9 at the angle of FIG. 6.

As shown in FIGS. 9 to 11, the base 3 consists substantially of two bells, a top bell 30 and a bottom bell 39, nested in one another. The wall of the bottom bell 39 defines a housing of cylindrical shape with an elliptical base designed to receive the plate 4. The shape of the top bell 30 is made substantially of the juxtaposition of a cylinder with a circular base and a prism with a triangular base with axes parallel to one another and to the axis of the bottom bell 39. The cylindrical portion of the bell 30 is designed to receive the bladed wheel 5, as shown in FIGS. 3 and 4, while the prismatic portion of the bell 30 forms a cleared volume 23 which allows the flow of a liquid L, if necessary laden with relatively large particles.

The upper contours of the bottom bell 39 and top bell 30 each have a ring 35 for the positioning of the bottom half-casing 2 on the base 3. The connection thus formed is supplemented by a seal not shown placed in a groove 351 of the ring 35, in order to render this connection sealed from the liquid to be cleared away.

The base 3 comprises a flat partition 37 which separates the volumes defined by the bells 30 and 39. The partition 37 has an inlet orifice 33, through which the aspirated liquid L can enter the enclosure 21. The inlet orifice 33 in this instance has a circular shape with a diameter $D_{33}$ greater than the maximum size of the particles to be cleared away. The inlet orifice 33 is level with the axis $Z_{22}$ and the four holes 43 made in the tray 40 are distributed in a symmetrical manner relative to the axis $Z_{22}$. The location of the holes 43 is defined so as to prevent the user having direct access to the bladed wheel 5, when the pump P is operating. This makes it possible to secure the pump P and preserve the wheel 5 and the motor 22. In this instance, none of the holes 43 faces the inlet orifice 33 of the pump P.

As shown in FIGS. 3 and 4, the orifice 33 places the enclosure 21 in communication with the first cavity 31 or with the second cavity 32, respectively depending on whether the pump P is configured for a laden liquid or for a clear liquid.

Several sets of ribs 391 are placed at regular intervals over the periphery of the inner wall of the bottom bell 39. The ribs 391 each have a flat rectangular shape placed with their upper edge secured to the inner wall of the bottom bell 39.

The bottom edge 392 of the ribs 391, that is to say the edge opposite to the top bell 30, serves as an abutment means for positioning the tray 40, therefore the plate 4, relative to the base 3, which makes it possible to form the first cavity 31 or the second cavity 32 and to cause the respective planes of the soles 361 and 461 to coincide in the configuration for clear liquids. In other words, the ribs 391 play the role of spacers between the inlet orifice 33 and the plate 4. The position of each set of ribs 391 is defined so that the ribs 391 fit into the notches 47 when the plate 4 is mounted in the configuration for clear liquid.

As shown in FIGS. 3 and 4, the enclosure 21, including the volume delimited by the top bell 30 of the base 3, has a volume 23 that is cleared of any obstacle between the inlet orifice 33 and the outlet socket 13. It is essentially through the volume 23 that the liquids L to be cleared away flow.

The movement of the particles in the pump P must not be hampered by any obstacle, since it is desired to clear them away through the pipe 14. That is why the respective discharging cross sections of the first cavity 31 of the inlet orifice 33 and of the volume 23 each have a minimal dimension of more than the maximal size of the particles to be cleared away.

In this instance, the pump P is designed to treat the consequences of flooding and of river overflow, so it is designed to remove, or clear away, water laden with stones that may reach 30 mm in their largest dimension. In practice, the minimal dimension of the discharging cross sections specified above may be greater than 32 mm. The bladed wheel 5 and the motor 22 are designed to pump a liquid thus laden. Similarly, the diameter $D_{43}$ of the holes 43 is planned to be greater than 30 mm. Furthermore, the width $L_{47}$ and the height $H_{47}$ of the notches 47 are planned to be slightly larger than the maximum size of the particles to be cleared away but slightly smaller than the dimensions of the discharging cross sections situated downstream. The notches 47 therefore fulfil the function of a sieve preventing the particles that are too large from entering the pump P, where they might remain jammed. In addition, once the notches are passed, the particles are sure to be cleared away.

The bladed wheel 5 is made of a fibre-filled polymer, capable of withstanding the abrasion and impacts by the particles, such as stones, transported by the liquid to be cleared away. The other parts that are likely to come into contact with these particles may also be made of a fibre-filled polymer.

The plate 4 is fastened to the base 3 by means of fastening elements which in this instance consist of two screws 6 screwed through holes 44 of the plate 4 and into tappings arranged in two fastening sockets 34 secured to the base 3. The screws 6 are arranged so as to be accessible from the outside of the enclosure 21 and of the pump P. Therefore, the user may rapidly remove the plate 4, turn it over, then reinstall it on the base 3 in order to change the configuration of the pump P.

Figure 6:
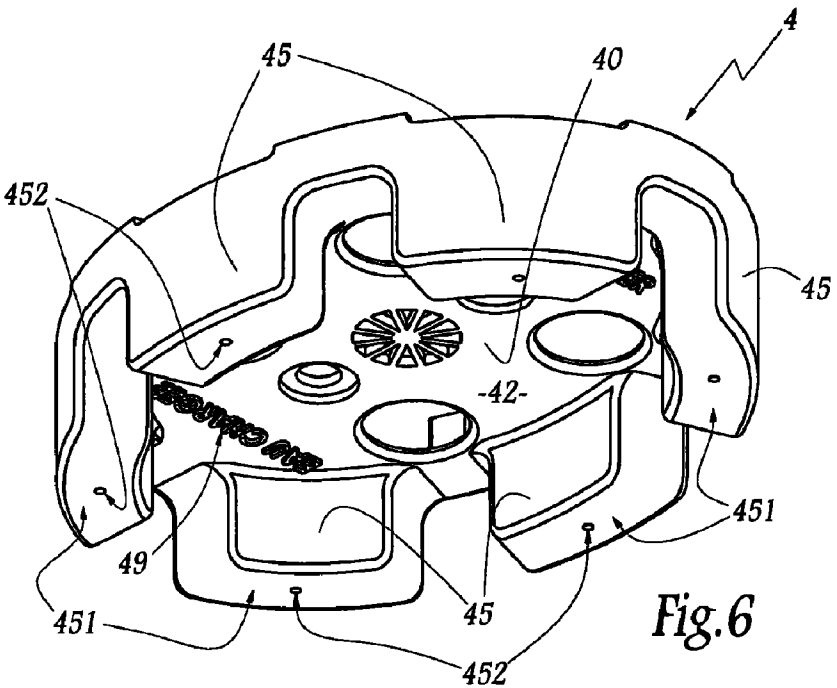
FIG. 6 is a view in perspective of the plate of FIG. 5 at a different angle.
Figure 5:
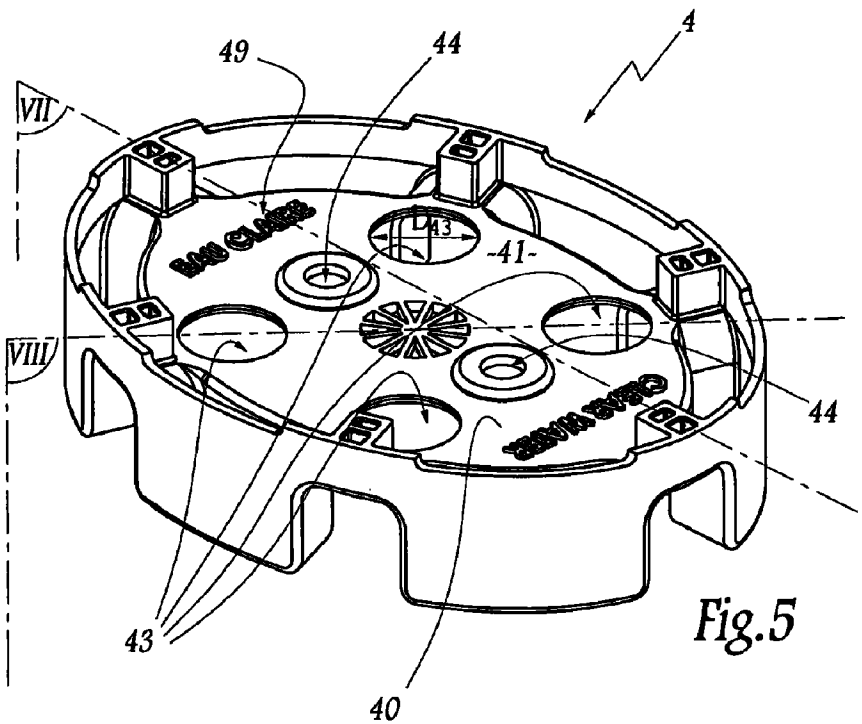
FIG. 5 is a view in perspective and on a larger scale of the plate of the pump of FIGS. 1 to 4.
Figure 7:
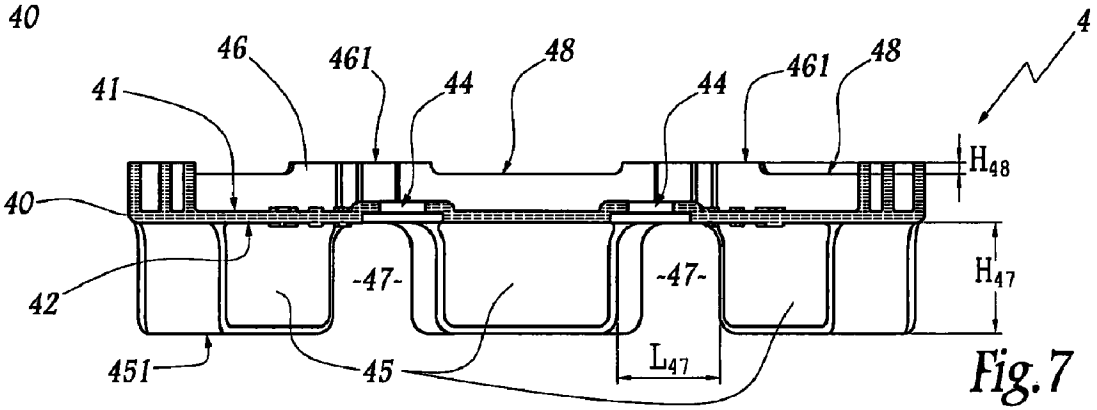
FIG. 7 is a section, along the plane VII in FIG. 5, of the plate of FIGS. 5 and 6.

As shown in FIGS. 5 and 6, the first face 41 and the second face 42 each comprise an item of information 49 on the mounting configuration of the plate 4, in order to guide the user when installing and/or removing the pump P. These items of information 49, respectively "clear water" and "laden water" correspond to the nature of the liquid L to be cleared away and must be visible beneath the pump.

Furthermore, the faces 41 and 42 also comprise information, not shown, explaining what must be done to change configuration.

The pump that is the subject of the invention therefore makes it possible to clear away either a clear liquid or a laden liquid, the conversion between these two uses being particularly simple to carry out. Therefore, the user is not obliged to choose the type of pump to purchase, nor to buy both types of pump. The invention also has the advantage of increasing production runs, and therefore to reduce the unit costs thereof, since all the parts of a pump according to the invention are common to both uses of such a pump, namely for clearing away a clear liquid or a laden liquid.

The invention claimed is:

1. A submersible pump, for removing liquids comprising:

an enclosure having at least one outlet for discharging liquid from the enclosure, an electric actuator with a rotary output shaft, a bladed wheel mounted in the enclosure and driven by the actuator and which rotates about an axis of the output shaft, wherein a wall of the enclosure is defined by a base and includes at least one inlet orifice communicating with an outside of the enclosure, and a plate mounted in a reversible manner close to the base in two distinct configurations, a first mounting configuration being designed for the passage of a liquid laden with solid particles, the other mounting configuration being designed for the passage of a clear liquid, the enclosure having a volume that is cleared of any obstacles between the inlet orifice and the outlet socket, so as to allow the liquid (L) laden with solid particles to flow away, wherein the plate has a first face defining at least one first opening for permitting a liquid to flow toward the at least one inlet orifice and an oppositely orient second face defining at least one second opening for permitting a liquid to flow toward the at least one inlet open and being of a smaller dimension than the at least one first opening, wherein in the first mounting configuration the first face of the plate is oriented toward a support surface for the pump and wherein the plate forms with the base at least one first cavity upstream of the at least one inlet opening, the dimensions (L47, H47) of the at least one first opening and of the at least one first cavity being for the passage of the liquid laden with solid particles, and wherein in the second configuration the second face of the plate is oriented toward the support surface and the plate forms with the base at least one second cavity, the first cavity being higher than the second cavity along the axis of the output shaft, the dimensions (H48) of the at least one second opening and of the at least second cavity being for the passage of the clear liquid.

2. The pump according to claim 1, wherein the plate has a portion common to the at least one first cavity and to the at least one second cavity, the common portion having at least one hole for the passage of laden or clear liquid.

3. The pump according to claim 1, wherein abutment means are provided on one of the base and the plate in order to position the plate relative to the base so as to form the at least one first cavity or the at least one second cavity.

4. The pump according to claim 1, wherein the wall defines a bottom of the enclosure and wherein the at least one outlet is on an upper portion of the enclosure, when the pump is in a position of use.

5. The pump according to claim 1, wherein the axis of the output shaft is vertical when the pump is in a position of use, and wherein the bladed wheel includes centrifugal-action blades.

6. The pump according to claim 2, wherein the at least one inlet orifice is aligned with the axis of the output shaft and wherein the plate has a plurality of holes therein for the passage of liquid, the holes being placed in a symmetrical manner relative to the axis of the output shaft.

7. The pump according to claim 1, wherein the respective discharging cross sections of the at least one first cavity, of the at least one inlet orifice and of the volume each have a minimal dimension of more than 30 mm.

8. The pump according to claim 7, wherein the dimensions ($H_{47}$, $L_{47}$) of the at least one first opening are smaller than the dimensions of the respective discharging cross sections of the at least one first cavity, of the at least one inlet orifice and of the volume, in order to prevent solid particles that must be removed from being jammed in the pump.

9. The pump according to claim 1, wherein the plate includes at least one item of information on at least one of the first and second opposite faces thereof, to properly orient the plate depending upon the nature of the liquid to be removed.

10. The pump according to claim 1, wherein the plate is fastened to the base by means of fastening elements that can be accessed from outside of the enclosure.

11. The pump according to claim 1, wherein at least one of the first and second faces of the plate has a flat bearing surface to support the pump in a stable manner on a flat surface.

* * * * *